US010305221B2

(12) United States Patent
Ohfuku

(10) Patent No.: US 10,305,221 B2
(45) Date of Patent: May 28, 2019

(54) CONNECTOR

(71) Applicant: Yazaki Corporation, Minato-ku, Tokyo (JP)

(72) Inventor: Ryosuke Ohfuku, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 16/119,009

(22) Filed: Aug. 31, 2018

(65) Prior Publication Data

US 2019/0067875 A1 Feb. 28, 2019

(30) Foreign Application Priority Data

Aug. 31, 2017 (JP) ..... 2017-168048

(51) Int. Cl.
*H01R 13/627* (2006.01)
*H01R 13/506* (2006.01)

(52) U.S. Cl.
CPC ..... *H01R 13/6273* (2013.01); *H01R 13/506* (2013.01)

(58) Field of Classification Search
CPC . H01R 13/627; H01R 13/506; H01R 13/6273
USPC ..... 439/352–357
See application file for complete search history.

(56) References Cited

U.S. PATENT DOCUMENTS

| | | | | |
|---|---|---|---|---|
| 7,559,787 | B2 * | 7/2009 | Shigeta | H01R 13/6272 439/358 |
| 9,666,989 | B2 * | 5/2017 | Horiuchi | H01R 13/64 |
| 9,742,115 | B2 * | 8/2017 | Matsumoto | H01R 13/6272 |
| 9,923,297 | B2 * | 3/2018 | Sekino | H01R 13/627 |
| 10,224,671 | B2 * | 3/2019 | Sekino | H01R 13/6272 |
| 2013/0210266 | A1 | 8/2013 | Osada et al. | |

FOREIGN PATENT DOCUMENTS

JP 2012-064461 A 3/2012

* cited by examiner

*Primary Examiner* — Khiem M Nguyen
(74) *Attorney, Agent, or Firm* — Banner & Witcoff, Ltd.

(57) ABSTRACT

A connector includes a connector housing and a fitting assurance member. A repulsion arm of the connector housing is sandwiched between an arm contact portion of a mating connector and an arm displacement regulation portion of the fitting assurance member and the repulsion arm is elastically deformed to be pressed to an outside by a leading end portion of the arm contact portion to be stretched in a straight line, when the leading end portion of the arm contact portion slides on an inner inclined surface of an arm inclined portion of the repulsion arm toward an arm leading end of the repulsion arm.

2 Claims, 8 Drawing Sheets

CONNECTOR

CROSS-REFERENCES TO RELATED APPLICATIONS

This application is based on and claims priority from Japanese Patent Applications No. 2017-168048 filed on Aug. 31, 2017, the entire contents of which are incorporated herein by reference.

BACKGROUND

1. Field of the Invention

The present invention relates to a connector.

2. Description of Related Art

In a connector having a pair of connector housings, by inserting one connector housing into a fitting position of the mating connector housing, terminals respectively accommodated in the connector housings are electrically connected with each other and the connector housings are locked with each other. Since a fitting operation of such a connector is manually performed, an operator may finish the fitting operation without recognizing a half-fitting (non-locking state) in which one connector housing is not inserted into a normal fitting position, and a locking may be released afterward.

JP-A-2012-064461 discloses a connector having a fitting position assurance lock for preventing the half-fitting of the connector housing.

The connector of JP-A-2012-064461 includes a tubular female housing having a female terminal received therein, a tubular male housing having a male terminal received therein and to be fitted into the female housing, a tubular fitting assurance member slidably mounted on an outside of the female housing, a female lock supported on the female housing in the form of a cantilever and extending toward the male housing, a fitting assurance lock supported on the fitting assurance member in the form of a cantilever and extending toward the male housing, and a locking projection protruding from an outer surface of the male housing to lock the female lock and the fitting assurance lock. The locking projection includes inclined surfaces to allow a locking portion of a leading end side of the female lock and a locking nail of a leading end side of the fitting assurance lock to climb thereon, respectively.

In the connector of JP-A-2012-064461, when the male housing is inserted into the female housing on which the fitting assurance member is mounted, the locking portion of the female lock climbs over the inclined surface of the locking projection and is locked to the locking projection, first. Then, the locking nail of the fitting assurance lock climbs over the inclined surface of the locking projection and the locking portion of the female lock, and is locked to the locking projection via the locking portion of the female lock. In this way, since the fitting assurance lock is locked to the locking projection via the female lock, the fitting of the housing is assured.

In the connector of JP-A-2012-64461, in the fitting process of the housing, the locking portion of the female lock and the locking nail of the fitting assurance lock are elastically displaced by sliding on the inclined surfaces of the locking projection in sequence. Thus, while the locking portion of the female lock slides on the inclined surface, a component force of a reaction force that the female lock receives from the inclined surface is applied to the female housing as a repulsive force related to the connector fitting. When an operator stops the fitting operation, the female housing is pushed back. While the locking nail of the fitting assurance lock slides on the inclined surface, a component force of a reaction force that the fitting assurance lock receives from the inclined surface is applied to the fitting assurance member as a repulsive force related to the connector fitting. When the operator stops the fitting operation, the female housing is pushed back via the fitting assurance member. The operator can recognize that the fitting is ongoing by feeling the corresponding repulsive force.

For small sizing an entire connector by decreasing a maximum displacement of the female lock, a top surface of the locking projection may be formed in a flat surface shape substantially parallel with a fitting direction. In this case, if the fitting assurance lock climbs on the top surface of the locking projection before the female lock is locked to the locking projection, the repulsive force may not be applied from the time the fitting assurance lock climbs until the connector is fitted, and the operator may not recognize half-fitting. In particular, if the repulsive force that has been applied before fitting is not applied, the operator may misunderstand that a connector fitting is completed and may finish the fitting operation in the half-fitted state.

SUMMARY

One or more embodiments relate to a connector which ensures application of a repulsive force until a completion of fitting.

In accordance with one or more embodiments, a connector includes a connector housing and a fitting assurance member. The connector housing is to be fitted to a mating connector housing by moving in a fitting direction with respect to the mating connector housing. The fitting assurance member is slidably attached on an outside of the connector housing, and configured to be locked to the mating connector housing by relatively sliding toward the mating connector housing in a connector fitted state in which the connector housing is fitted to the mating connector housing. The connector housing includes a repulsion arm. An arm base end portion and an arm inclined portion are integrally formed in the repulsion arm. The arm base end portion is supported on the connector housing and includes a cantilever structure having a fixing end on a fitting side with the mating connector housing and extending toward an opposite fitting side along the fitting direction. The arm inclined portion extends from a leading end of the arm base end portion to an arm leading end on the opposite fitting side, and the arm inclined portion is inclined inward the connector housing with respect to the arm base end portion. The fitting assurance member includes an arm displacement regulation portion facing an outside of the repulsion arm to regulate a displacement of the repulsion arm toward an outside. The arm inclined portion is arranged so that a leading end portion of an arm contact portion of the mating connector housing comes into contact with an inside of an inner inclined surface of the arm inclined portion and the leading end portion of the arm contact portion of the mating connector housing slides on the inside of the inner inclined surface of the arm inclined portion by a movement of the connector housing in the fitting direction. The repulsion arm is configured, so that the repulsion arm is sandwiched between the arm contact portion and the arm displacement regulation portion and the repulsion arm is elastically deformed to be pressed to an outside by the leading end portion of the arm contact portion to be stretched in a straight line, when the leading end portion of the arm contact portion slides on the inner inclined surface toward an arm leading end of the repulsion arm. The arm inclined portion is arranged so that the leading end portion of the arm contact portion starts sliding on the inner inclined surface of the arm inclined portion before the connector housing and the mating connector housing are fitted to each other, and the leading end portion of the arm contact portion is positioned on the inner inclined surface of the arm inclined portion until the connector housing and the mating connector housing are fitted to each other.

Other aspects and advantages of the invention will be apparent from the following description and the appended claims.

DETAILED DESCRIPTION

Figure 1:
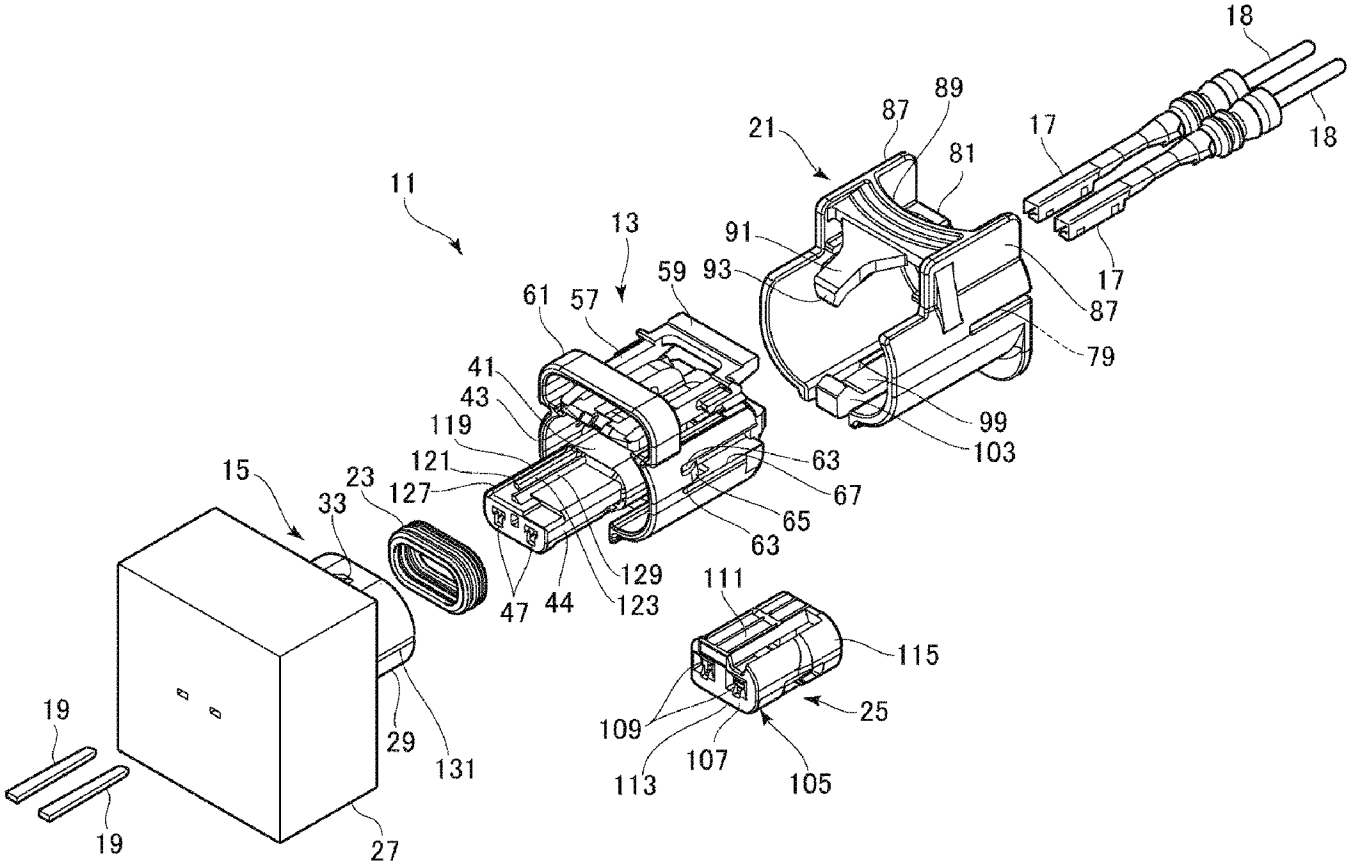
FIG. 1 is an exploded perspective view of a connector according to an exemplary embodiment.
Figure 2:
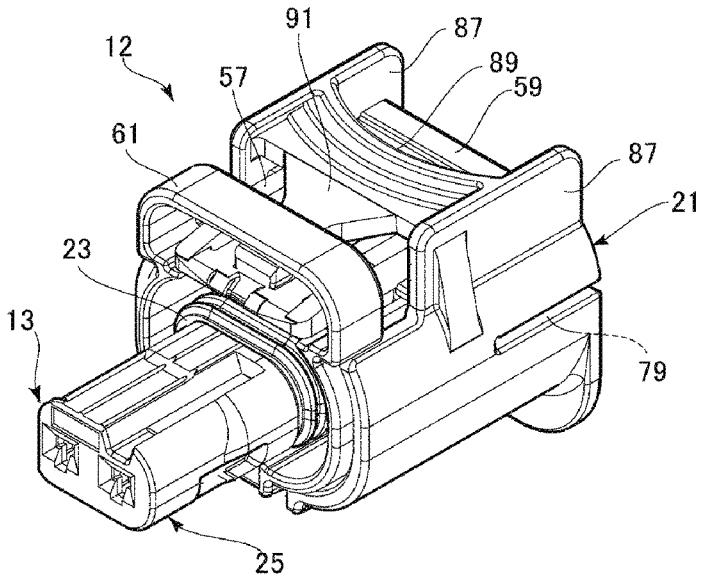
FIG. 2 is an exterior perspective view of a female connector unit.
Figure 3:
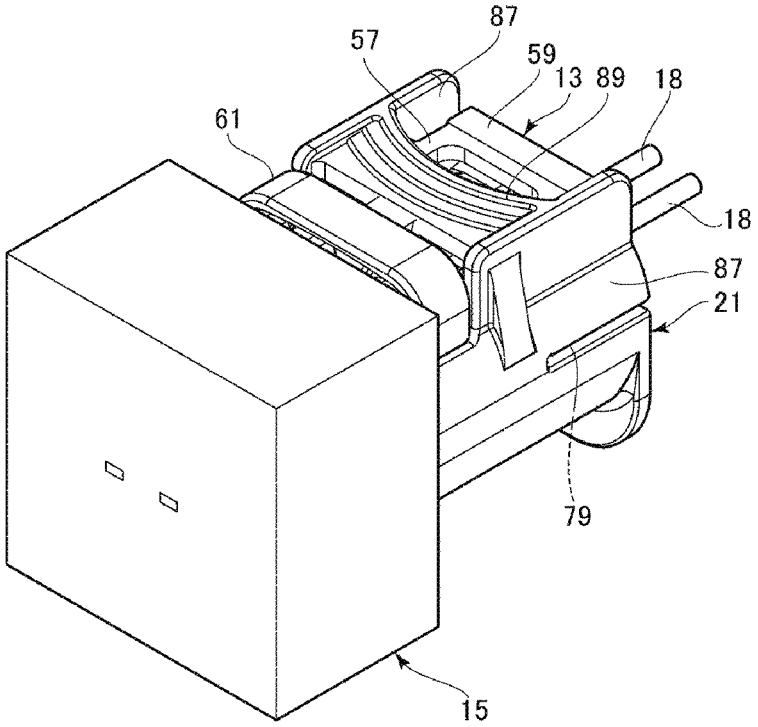
FIG. 3 is an exterior perspective view in a CPA final locking state.

A connector according to an exemplary embodiment will be described with reference to the drawings. FIG. 1 is an exploded perspective view of the connector 11 of the exemplary embodiment, FIG. 2 is an exterior perspective view of a female connector unit (connector unit) 12 having a CPA 21, a seal member 23, and a side retainer 24 mounted on a female housing 13, FIG. 3 is an exterior perspective view in a connector fitted state, and FIGS. 4 to 8 are longitudinal cross section views illustrating a movement from before the connector is fitted until the CPA is finally locked. In the following description, a direction of fitting into the mating connector will be referred to as a forward direction (fitting direction), a direction of separating from the mating connector will be referred to as a backward direction (opposite fitting direction), one side (upper side in FIG. 4) of a connector height direction (height direction) substantially perpendicular to the fitting direction will be referred to as an upward direction, and the other side (downside in FIG. 4) will be referred to as a downward direction, and a connector width direction (width direction) substantially perpendicular to the fitting direction and the connector height direction will be referred to as a horizontal direction.

As shown in FIG. 1, the connector 11 includes a tubular female housing (connector housing) 13, a tubular male housing (the mating connector housing) 15, a female terminal 17 received in the female housing 13, a male terminal 19 received in the male housing 15, a tubular CPA (fitting assurance member) 21 mounted on an outer surface of the female housing 13 to be slidable in the fitting direction, an annular seal member 23 mounted on the female housing 13, and a side retainer 25 mounted in the female housing 13. The female housing 13, the CPA 21, the seal member 23, and the side retainer 25 constitute a female connector unit 12. The connector 11 of the present exemplary embodiment connects the two pairs of the female terminals 17 and the male terminals 18 to each other, and the two female terminals 17 are accommodated in the female housing 13, and the two male terminals 19 are accommodated in the male housing 15.

Figure 4:
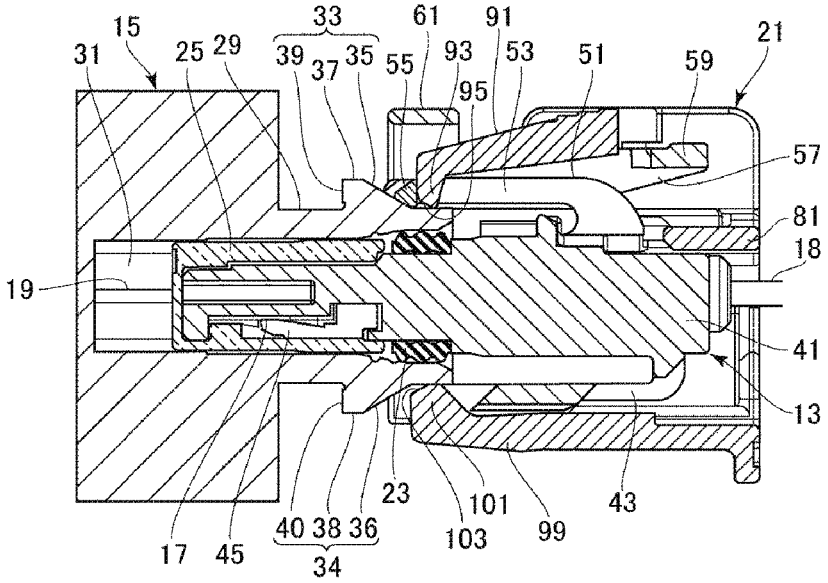
FIG. 4 is a longitudinal section view before the connector is fitted.

The male housing 15 is made from a synthetic resin. For example, the male housing 15 is directly connected to a container wall of an electric device (not shown) loaded on a vehicle, etc. As shown in FIG. 1, the male housing 15 includes a base end portion 27 corresponding to the container wall, and a cylindrical hood portion 29 extending from the base end portion 27 in the fitting direction. As shown in FIG. 4, a bottomed space 31 having an inner circumference surface connected to an inner circumference surface of the hood portion 29 in an axial direction is formed in the base end portion 27. The tab-shaped male terminal 19 protruding in the fitting direction is fixed to an inside of the space 31.

An upper locking projection 33 protrudes from an upper surface of an outer circumference of the hood portion 29. As shown in FIG. 4, the upper locking projection 33 includes an upper inclined surface 35 having a protrusion height increasing in the backward direction, an upper flat surface 37 connected to an upper end (rear end) of the upper inclined surface 35 and extending in a longitudinal direction, and an upper locking surface 39 connected to a rear end of the upper flat surface 37 and rising in a substantially perpendicular direction. The upper flat surface 37 has a length in the width direction set large, and a length in the longitudinal direction set short with reference to the upper inclined surface 35. Likewise, a lower locking projection 34 protrudes from a lower surface of the outer circumference of the hood portion 29. The lower locking projection 34 includes a lower inclined surface (the other inclined surface) 36 having a protrusion height increasing in the backward direction, and a lower flat surface 38 connected to a lower end (rear end) of the lower inclined surface 36 and extending in the longitudinal direction. A length of the lower flat surface 38 in the width direction is larger than a length of the lower inclined surface 36 in the width direction. A length of the lower flat surface 38 in the longitudinal direction is shorter than a length of the lower inclined surface 36 in the longitudinal direction. The upper locking projection 33 and the lower locking projection 34 are formed to be vertically substantially symmetric to each other. In the fitting direction, the upper inclined surface 35 and the lower inclined surface 36 are positioned in a substantially same range. In the fitting direction, the upper flat surface 37 and the lower flat surface 38 are positioned in a substantially same range.

Left and right sidewalls of the hood portion 29 include regions (left and right arm contact portions 131) facing insides of repulsion arms 65 of the female housing 13 when being fitted to the female housing 13.

The female housing 13 is made from a synthetic resin. As shown in FIG. 4, the female housing 13 includes a cylindrical inner housing 41 and a cylindrical outer housing 43 formed in alignment with each other. The outer housing 43 surrounds an outer circumference surface of the inner housing 41, spaced apart therefrom. The hood portion 29 of the male housing 15 is inserted into a gap between the outer circumference surface of the inner housing 41 and an inner circumference surface of the outer housing 43.

Two female terminal receiving chambers 45 into which the female terminals 17 are inserted from the rear are formed in the inner housing 41. Each of the female terminal receiving chambers 45 is opened to the outside via an insertion hole 47 (see FIG. 1) formed on a leading end portion of the inner housing 41. The tab-shaped male terminal 19 is inserted from each insertion hole 47.

The inner housing 41 protrudes forward further than a front end surface of the outer housing 43. The seal member 23 is mounted on a cylindrical outer circumference surface of the inner housing 41 surrounded by the outer housing 43. The side retainer 25 is mounted on an outer circumference surface of a square tube-shaped inner housing front portion 44 protruding forward from the outer housing 43.

An elastically displaceable housing arm 51 is formed on the outer circumference surface of the female housing 13. The housing arm 51 is formed in the form of a gate. The housing arm 51 is supported on the outer circumference surface of the female housing 13 (inner housing 41). The housing arm 51 has a cantilever shape in which the housing arm 51 includes one pair of left and right elastic arm pieces extending toward the male housing 15 substantially in parallel with the outer circumference surface of the inner housing 41, and a locking piece 55 bridging over front end portions of the elastic arm pieces 53 in the width direction. The locking piece 55 is locked to the upper locking projection 33 of the male housing 15 when both the housings 13 and 15 are fitted to each other.

The housing arm 51 is elastically displaceable (flexibly deformable) with a rear end portion as a fulcrum so that the locking piece 55 is movable upward (outward). Gate-shaped lock arms 57 which are supported on the front end portions of one pair of elastic arm pieces 53 in the form of a cantilever, respectively, and extend backward are connected to the housing arm 51. The lock arm 57 includes an unlocking operation portion 59 which is pressed down in an unlocking operation direction toward the female housing 13 (inner housing 41) when the locking state of the housing arm 51 is released. The unlocking operation portion 59 is spaced apart from a rear portion (opposite fitting side) of the female housing 13 (inner housing 41) toward the outside (upward). The unlocking operation portion 59 is disposed on a higher position than the elastic arm piece 53. When the unlocking operation portion 59 is pressed down and displaced in the unlocking operation direction, an upward (opposite locking direction) unlocking force is applied to the locking piece 55 via the lock arm 57.

The female housing 13 includes a female housing bridge 61. The female housing bridge 61 extends upward from both left and right ends of an upper portion of a front end of the outer housing 43, crosses in the width direction, and covers the locking piece 55 from the outside (upper side). The female housing bridge 61 is in a position where the locking piece 55 can be elastically displaced by the upper inclined surface 35 of the male housing 15, and is disposed in the proximity of an outside (upper side) of a movement range of the locking piece 55.

Figure 9:
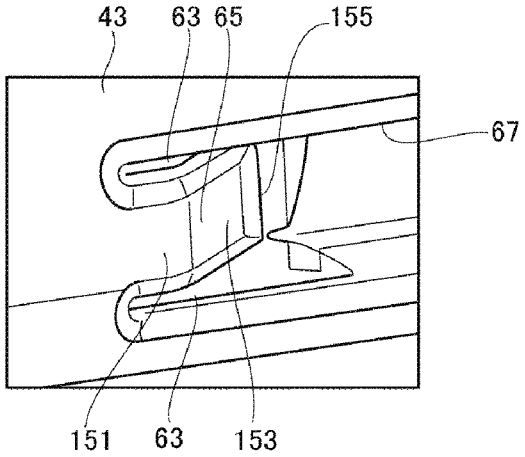
FIG. 9 is an enlarged view of a repulsion arm.

As shown in FIGS. 1 and 9, the female housing 13 includes one pair of left and right repulsion arms 65 which are partitioned and defined by cutting off a portion of left and right sidewalls of the outer housing 43 by one pair of upper and lower slits 63. A flat plate-shaped arm base end portion 151 and a flat plate-shaped arm inclined portion 153 are integrally formed in the repulsion arm 65. The arm base end portion 151 has a front end (an end in a fitting side with the male housing 15) connected with the sidewall of the outer housing 43. The arm base end portion 151 is supported on the outer housing 43 in a cantilever shape having a fixing end at the front end and extending backward (opposite fitting side) in the longitudinal direction (fitting direction). The arm inclined portion 153 is bent from the leading end (rear end) of the arm base end portion 151. The arm inclined portion 153 extends toward an arm leading end (free end) 155 of the back (opposite fitting side) to be inclined inward the outer housing 43 with reference to the arm base end portion 151. The respective repulsion arms 65 are positioned on front end portions of one pair of guide grooves 67 extending on both left and right sides of the outer housing 43 in the longitudinal direction, and the upper and lower slits 63 extend forward from the guide groove 67. The arm inclined portion 153 may have a curved plate shape.

The side retainer 25 is made from a synthetic resin. As shown in FIG. 1, the side retainer 25 includes a retainer main body 105 which has one side (side portion) in the width direction opened and has a U-shape cross section, and a retainer front plate portion 107 covering a front end of the retainer main body. Two insertion holes 109 are formed on the retainer front plate portion 107. The insertion holes 109 communicates with the insertion holes 47 of the inner housing 41 when the side retainer 25 is set in a final locking position. The male terminals 19 are inserted from the insertion holes 47 and 109.

The retainer main body 105 integrally includes a retainer upper surface portion 111 and a retainer lower surface portion 113 which are vertically separated from each other and face each other, and a retainer curved surface portion 115 connecting an edge of the retainer upper surface portion 111 and an edge of the retainer lower surface portion 113. A retainer projection (not shown) which extends in a straight line in the fitting direction protrudes downward from an edge of an opening side of the retainer upper surface portion 111.

A final locking groove 121 and a temporary locking groove 123 are arranged on an upper surface of the inner housing front portion 44 with a partition 119 being disposed therebetween. The partition 119, the final locking groove 121, and the temporary locking groove 123 extend in a straight line in the fitting direction. The final locking groove 121 is partitioned between a sidewall upper end portion 127 of the inner housing front portion 44 protruding from the upper surface of the inner housing front portion 44 and the partition 119. The temporary locking groove 123 is partitioned between a groove forming projection 129 protruding from the upper surface of the inner housing front portion 44, and the partition 119.

In order to attach the side retainer 25 to the inner housing front portion 44, the opening of the side of the side retainer 25 is slightly opened, and the inner housing front portion 44 is inserted into an inside of the side retainer 25 from the opening and is moved in the width direction (mounting direction). When the side retainer 25 is moved in the mounting direction, the retainer projection enters the temporary locking groove 123 and is locked thereto (temporary locking position). Then, when the side retainer 25 is further moved in the mounting direction, the retainer projection enters the final locking groove 121 and is locked thereto (final locking position).

The side retainer 25 set in the temporary locking position allows the female terminals 17 to be inserted into the female terminal receiving chambers 45, and also, locks the inserted female terminals 17 so as to prevent the female terminals 17 from being released. In contrast, the side retainer 25 set in the final locking position prevents both insertion of the female terminals 17 into the female terminal receiving chambers 45, and release of the female terminals 17.

The CPA 21 is made from a synthetic resin. The CPA 21 covers the female housing 13 from the rear so that the CPA 21 is slidable with respect t the female housing 13 in the fitting direction. That is, a moving direction (lock direction and opposite lock direction) of the CPA 21 with respect to the female housing 13 is set to the same direction as a direction in which the female housing 13 is fitted and released with respect to the male housing 15 (fitting direction and opposite fitting direction). The CPA 21 includes one pair of left and right sidewalls 87 which extend upward, spaced apart from each other in the width direction, and face each other on the outside of the female housing 13. The CPA 21 also includes a support wall 89 bridging between upper end portions of the respective sidewalls 87. A CPA upper arm 91 extending toward the male housing 15 is formed on a center portion of the support wall 89. One pair of left and right projection portions 79 to be guided on the left and right guide grooves 67 of the female housing 13, respectively, protrude from inner surfaces of rear portions of the left and right sidewalls 87 (see FIG. 1). Rear ends of the left and right sidewalls 87 are connected with each other by a flat plate-shaped CPA bridge 81 for assuring rigidity of the CPA 21.

Figure 10:
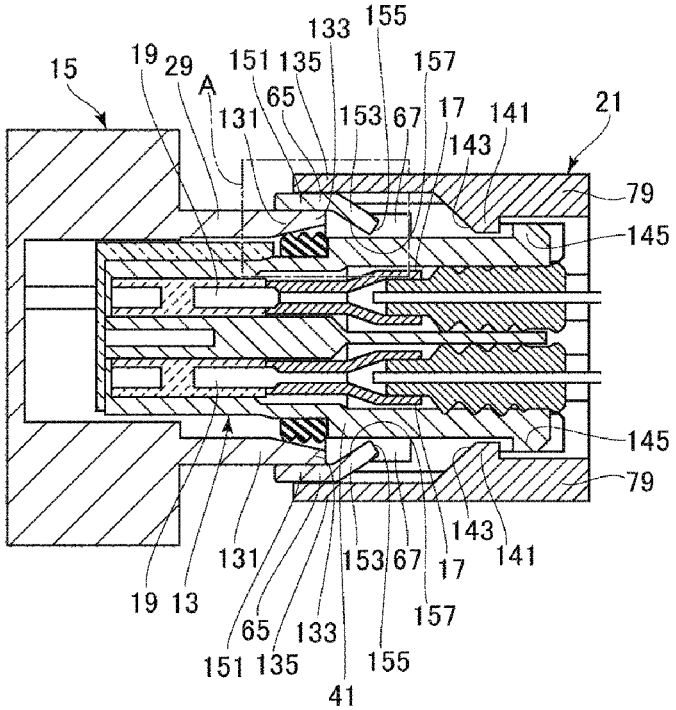
FIG. 10 is a cross section view in the middle of fitting the connector.

As shown in FIG. 10, a release prevention projection 141 protruding inward is formed on the projection portion 79. A guide surface 143 inclining outward in the forward direction is formed on a front portion of the release prevention projection 141. One pair of left and right stopper projections 145 protruding outward are formed on a rear end of the inner housing 41.

Each of the left and right sidewalls 87 includes a region (left and right arm displacement regulation portions 135) facing an outside of the repulsion arm 65 of the female housing 13 to regulate a displacement of the repulsion arm 65 toward the outside when being mounted on the female housing 13. Each arm displacement regulation portion 135 is positioned on a front portion of the release prevention projection 141.

The CPA upper arm 91 is supported on the support wall 89 in the form of a cantilever. The CPA upper arm 91 tilts downward toward the hood portion 29 of the male housing 15. An upper locking nail 93 protruding downward is formed on a leading end portion of the CPA upper arm 91. An inclined surface 95 is formed on a front surface of a lower portion of the upper locking nail 93. The CPA upper arm 91 is elastically displaceable (flexibly deformable) with the rear end portion as a fulcrum, so that the upper locking nail 93 is movable upward (outward). In the exemplary embodiment, when the CPA 21 is mounted on the female housing 13, the upper locking nail 93 (inclined surface 95) of the CPA upper arm 91 climbs over the unlocking operation portion 59 of the lock arm 57. The CPA upper arm 91 comes into contact with the rear end portion of the locking piece 55 of the housing arm 51 so as to press the rear end portion of the locking piece 55 in the fitting direction (forward direction) when both the housings 13 and 15 are fitted to each other.

The CPA 21 includes a CPA lower arm 99 which is supported on a position (a position distanced by about 180 degrees) facing the CPA upper arm 91 in the form of a cantilever, and extends toward the male housing 15. A lower locking nail 101 extending inward the CPA 21 is formed on a leading end portion of the CPA lower arm 99. An inclined surface 103 is formed on a front surface of an upper portion of the lower locking nail 101. In the same way as in the CPA upper arm 91, the CPA lower arm 99 is elastically displaceable (flexibly deformable) with the rear end portion as a fulcrum so that the lower locking nail 101 is movable downward (outward).

A fitting procedure of the connector 11 of the exemplary embodiment will be described, and the other configuration of the above-described connector 11 will be described. Hereinafter, an operation of the connector 11 when the female housing 13 approaches the male housing 15 directly connected to a container wall of an electric device will be described by way of an example.

First, the seal member 23 is mounted on the female housing 13, and the side retainer 25 is mounted in the temporary locking position of the inner housing front portion 44 protruding from the outer housing 43. Next, the female terminals 17, having electric wires 18 connected thereto, are inserted into the female terminal receiving chambers 45 of the female housing 13 from the rear, and the side retainer 25 is slid into the final locking position (normal position). Accordingly, the female terminals 17 are retained and locked to the side retainer 25.

Next, the CPA 21 is mounted on the female housing 13 from the rear. In this case, one pair of projection portions 79 of the CAP 21 are guided along the guide grooves 67. When the stopper projection 145 climbs over the guide surface 143 and reaches the temporary locking position (CPA temporary locking position) of the rear portion of the release prevention projection 141, the CPA 21 is retained and locked to the female housing 13 (CPA temporary locking). The CPA upper arm 91 climbs over the unlocking operation portion 59 of the female housing 13, and moves on an inside of the housing arm 51, and comes into contact with the rear end surface of the locking piece 55. As described above, the CPA upper arm 91 comes into contact with the locking piece 55, such that the CPA 21 can push the male housing 15 in the fitting direction. Therefore, positioning accuracy of the CPA 21 and the female housing 13 during the fitting operation increases, and an assembling efficiency can be enhanced.

When the CPA 21 is moved forward with respect to the female housing 13, the CPA upper arm 91 comes into contact the locking piece 55. Accordingly, the female housing 13 moves forward along with the CPA 21. To the contrary, when the CPA 21 is moved backward with respect to the female housing 13, the stopper projection 145 is locked to the release prevention projection 141. Accordingly, the female housing 13 moves backward along with the CPA 21.

When the female housing 13 is aligned with a position of the male housing 15 in the CPA temporary locking state, and the CPA 21 is pushed in the fitting direction (forward), the inner housing 41 of the female housing 13 is inserted into the hood portion 29 of the male housing 15, and leading end portions of the male terminals 19 are inserted into the insertion holes 47. In this step, the housing arm 51 and the CPA upper arm 91 are both distant from the upper locking projection 33, and a flexible deformation does not occur. The CPA lower arm 99 is also distant from the lower locking projection 34, and a flexible deformation does not occur. Furthermore, the arm inclined portion 153 of the repulsion arm 65 is also distant from the arm contact portion 131, and a flexible deformation does not occur.

When the CPA 21 is further pushed in the fitting direction, as shown in FIG. 4, the locking piece 55 of the housing arm 51 reaches the upper inclined surface 35 of the upper locking projection 33, and climbs thereover, and is accompanied by an elastic displacement in the upward direction (opposite locking direction) and starts sliding on the upper inclined surface 35. The locking piece 55 is pressed to the upper inclined surface 35, and the housing arm 51 is elastically deformed upward. Accordingly, a restoring force of the housing arm 51 is applied to the upper inclined surface 35, and the male housing 15 is biased by the female housing 13 in the opposite direction of the fitting direction, and the female housing 13 receives a reaction from the male housing 15. As a result, when the CPA 21 gripped by a hand is released, the female housing 13 is pushed back in the opposite direction to the fitting direction along with the CPA 21. In the state as shown in FIG. 4, the CPA lower arm 99 is distant from the lower locking projection 34, and a flexible deformation does not occur.

Figure 13A:
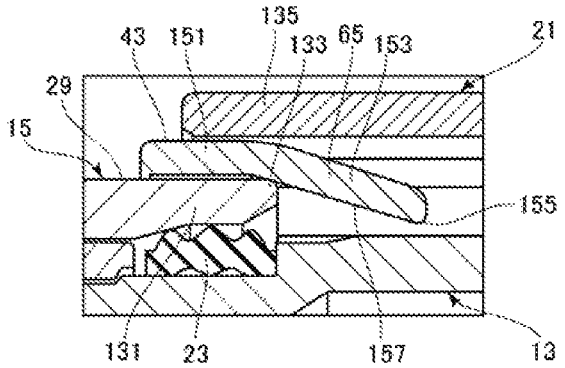
FIG. 13A is an enlarged view of a portion A of FIG. 10.

As shown in FIGS. 10 and 13A, an inner inclined surface 157 of the arm inclined portion 153 of the repulsion arm 65 of the female housing 13 reaches a leading end portion 133 of the arm contact portion 131 of the male housing 15, and the leading end portion 133 of the arm contact portion 131 comes in contact with an inside of the inner inclined surface 157 of the arm inclined portion 153 and rides thereon, and is accompanied by an elastic deformation of the repulsion arm 65 and starts sliding on the inner inclined surface 157. The repulsion arm 65 is pressed to the outside by the leading end portion 133 of the arm contact portion 131, and starts the elastic deformation to be stretched in a straight line (flat plate shape) according to an increase of a range between the arm contact portion 131 and the arm displacement regulation portion 135 of the CPA 21. Accordingly, the restoring force of the repulsion arm 65 is applied to the arm contact portion 131, the male housing 15 is biased by the female housing 13 in the opposite direction of the fitting direction, and the female housing 13 receives a reaction from the male housing 15. As a result, when the CPA 21 gripped by a hand is released, the female housing 13 is pushed back in the opposite direction of the fitting direction along with the CPA 21.

A bending angle (an inclination angle of the arm inclination portion 153 from the arm base end portion 151) of the repulsion arm 65 increases (approximates a flat plate shape) as the fitting proceeds (the leading end portion 133 of the arm contact portion 131 moves to the rear of the female housing 13).

Figure 5:
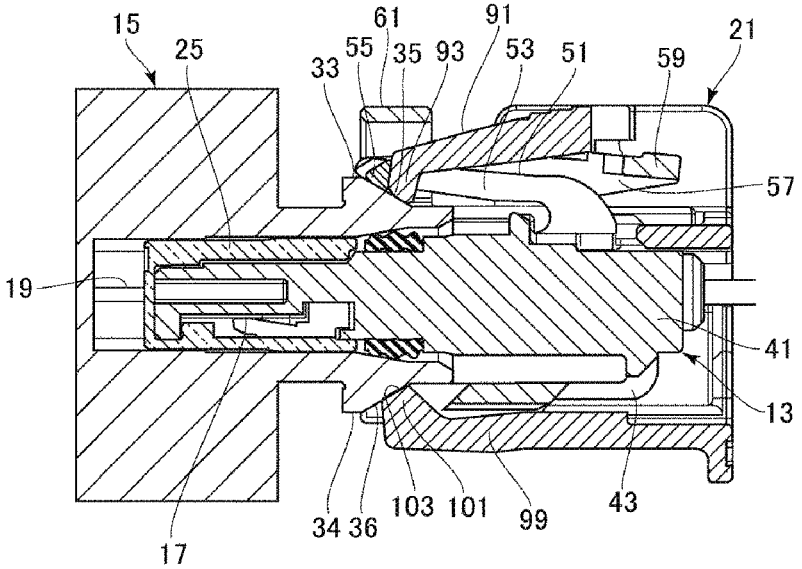
FIG. 5 is a longitudinal section view in the middle of fitting the connector.

When the CAP 21 is further pushed in the fitting direction from the state of FIG. 4, as shown in FIG. 5, the upper locking nail 93 of the CPA upper arm 91 reaches the upper inclined surface 35 of the upper locking projection 33 and rides thereon, and starts sliding on the upper inclined surface 35, and the upper locking nail 93 is pressed to the upper inclined surface 35, and the CPA upper arm 91 is elastically deformed upward. Accordingly, a restoring force of the CPA upper arm 91 is applied to the upper inclined surface 35, and the male housing 15 is biased by the CPA 21 in the opposite direction of the fitting direction, and the CPA 21 receives a reaction from the male housing 15. When the upper locking nail 93 of the CPA upper arm 91 starts sliding on the upper inclined surface 35 of the upper locking projection 33, the locking piece 55 of the housing arm 51 is also still sliding on the upper inclined surface 35, and the female housing 13 also receives a reaction from the upper inclined surface 35 generated by the elastic displacement of the locking piece 55. Furthermore, at the same time as the upper locking nail 93 of the CPA upper arm 91 starts sliding on the upper inclined surface 35, the lower locking nail 101 of the CPA lower arm 93 starts sliding on the lower inclined surface 36 of the lower locking projection 34, and the lower locking nail 101 is pressed to the lower inclined surface 36, and the CPA lower arm 99 is elastically deformed downward. Accordingly, a restoring force of the CPA lower arm 99 is applied to the lower inclined surface 36, and the male housing 15 is biased by the CPA 21 in the opposite direction of the fitting direction, and the CPA 21 receives a reaction from the male housing 15.

Figure 11:
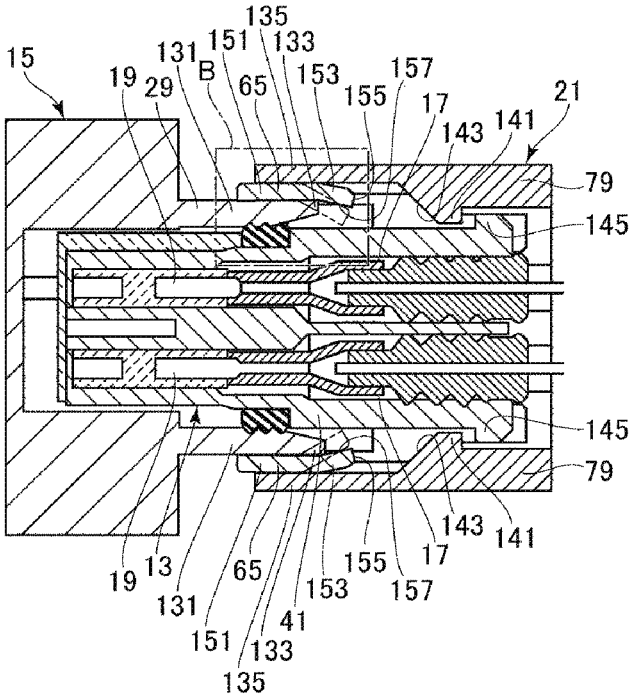
FIG. 11 is a cross section view in the middle of fitting the connector.
Figure 13B:
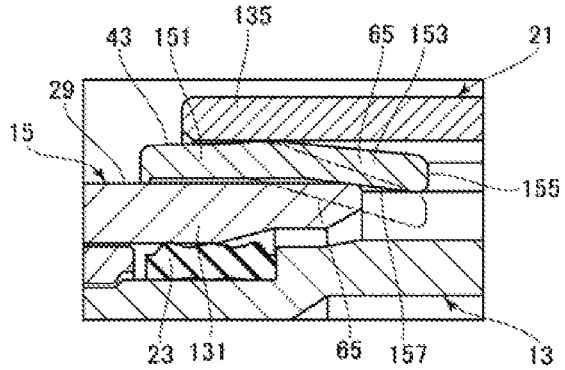
FIG. 13B is an enlarged view of a portion B of FIG. 11.

As shown in FIGS. 11 and 13B, the leading end portion 133 of the arm contact portion 131 is positioned on the inner inclined surface 157 of the arm inclined portion 153, and the restoring force of the repulsion arm 65 is continuously applied to the arm contact portion 131, and the female housing 13 receives a reaction from the male housing 15.

Figure 6:
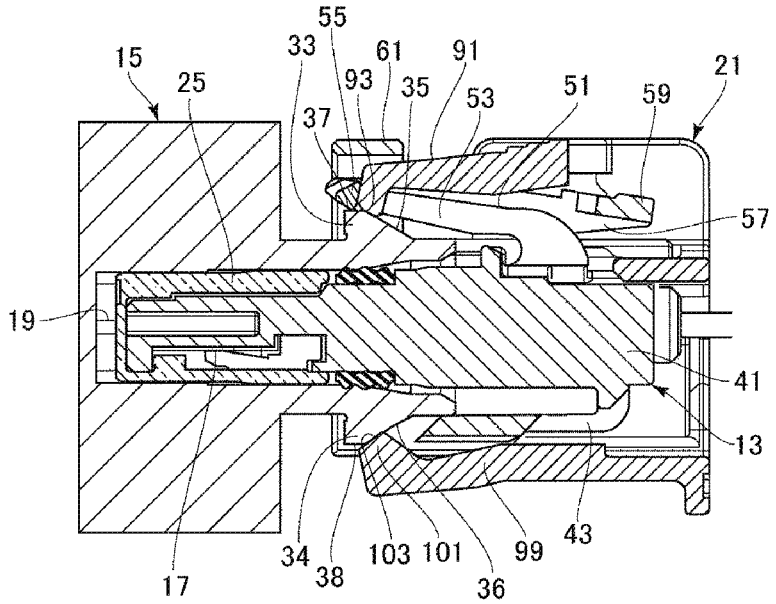
FIG. 6 is a longitudinal section view in the middle of fitting the connector.

When the CPA 21 is further pushed in the fitting direction from the state of FIG. 5, the locking piece 55 of the housing arm 51 climbs over the upper inclined surface 35 and reaches the upper flat surface 37 as shown in FIG. 6. Accordingly, the restoring force of the housing arm 51 is not applied to the upper inclined surface 35, and the housing arm 51 becomes unable to push back the male housing 15.

When the locking piece 55 rides on the upper flat surface 37, the upper locking nail 93 of the CPA upper arm 91 is still positioned on the upper inclined surface 35. Accordingly, the CPA 21 receives a reaction from the upper inclined surface 35 generated by the elastic displacement of the upper locking nail 93. In the same way, when the locking piece 55 rides on the upper flat surface 37, the lower locking nail 101 of the CPA lower arm 99 is also still positioned on the lower inclined surface 36. Accordingly, the CPA 21 receives a reaction from the lower inclined surface 36 generated by the elastic displacement of the lower locking nail 101.

When the locking piece 55 rides on the upper flat surface 37, the arm inclined portion 153 is set to allow the leading end portion 133 of the arm contact portion 131 to continuously slide on the inner inclined surface 157 of the arm inclined portion 153, and the female housing 13 receives a repulsive force in the opposite fitting direction generated by the elastic deformation of the repulsion arm 65.

When the CPA 21 is further pushed in the fitting direction from the state of FIG. 6, the leading end portion 133 of the arm contact portion 131 does not still reach the arm leading end 155 of the repulsion arm 65, and the leading end portion 133 of the arm contact portion 131 continuously slides on the inner inclined surface 157 of the arm inclined portion 153 while the locking piece 55 is moving on the upper flat surface 37.

Figure 7:
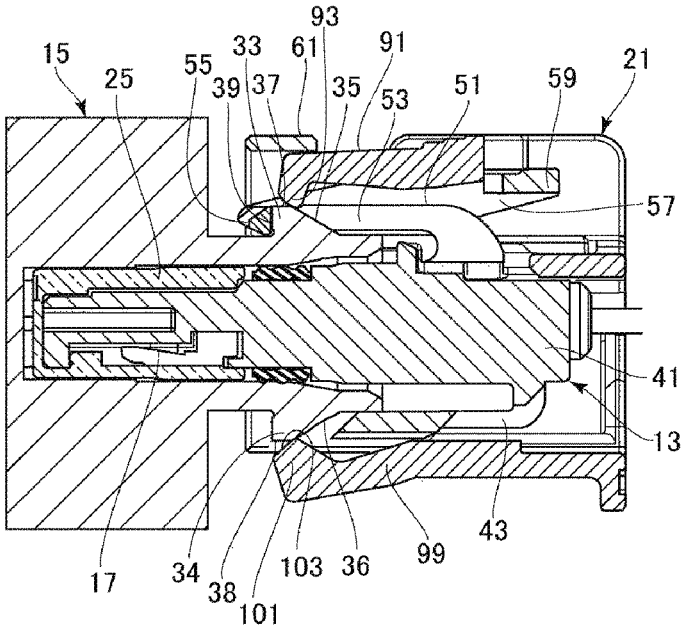
FIG. 7 is a longitudinal section view in a connector fitted state.
Figure 12:
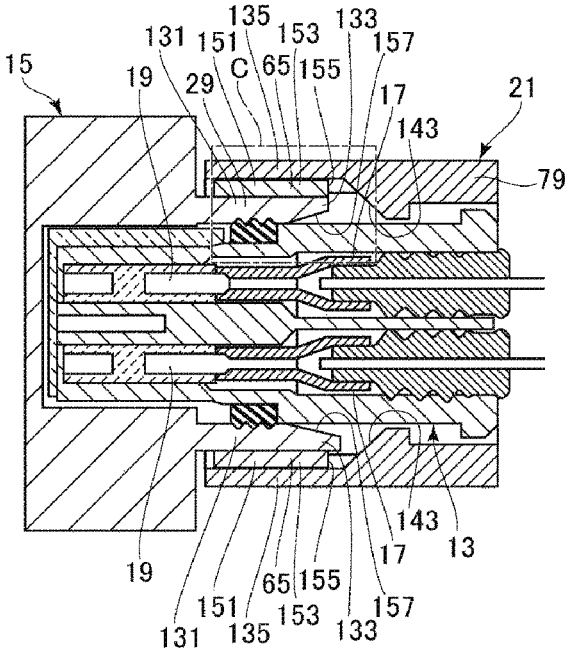
FIG. 12 is a cross section view in a CPA final locking state.
Figure 13C:
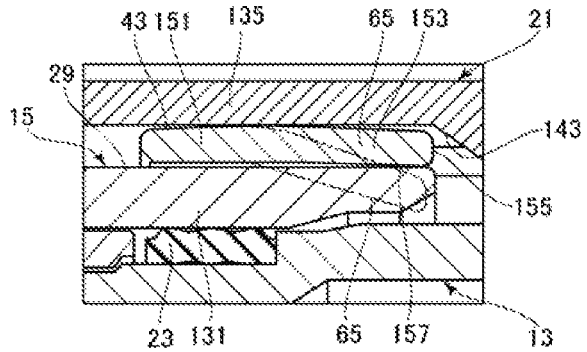
FIG. 13C is an enlarged view of a portion C of FIG. 12.

As shown in FIG. 7, when the locking piece 55 passes the upper flat surface 37, the locking piece 55 is restored and displaced downward (locking direction), and is locked to the upper locking surface 39 of the upper locking projection 33, and both the housings 13, 15 are locked to each other (connector fitting state). At the substantially same time as the relevant fitting is completed, as shown in FIGS. 12 and 13C, the leading end portion 133 of the arm contact portion 131 reaches the arm leading end 155 of the repulsion arm 65, and the repulsion arm 65 is stretched in a substantially straight line (in a substantially flat plate shape) between the arm contact portion 131 and the arm displacement regulation portion 135, completely rides on the arm contact portion 131, and is received between the arm contact portion 131 and the arm displacement regulation portion 135.

Even in the connector fitted state, the leading end portion 133 of the arm contact portion 131 may not still reach the arm leading end 155 of the repulsion arm 65, and may be set to be positioned on the inner inclined surface 157 of the arm inclined portion 153. In addition, when the locking piece 55 and the upper locking projection 33 are locked to each other, the upper locking nail 93 of the CPA upper arm 91 may be set to be still positioned on the upper inclined surface 35. In this case, the CAP 21 may also receive the reaction from the upper inclined surface 35 generated by the elastic displacement of the upper locking nail 93. In the same way, when the locking piece 55 and the upper locking projection 33 are locked to each other, the lower locking nail 101 of the CPA lower arm 99 may be set to be still positioned on the lower inclined surface 36. In this case, the CPA 21 may receive the reaction from the lower inclined surface 36 generated by the elastic displacement of the lower locking nail 101.

Figure 8:
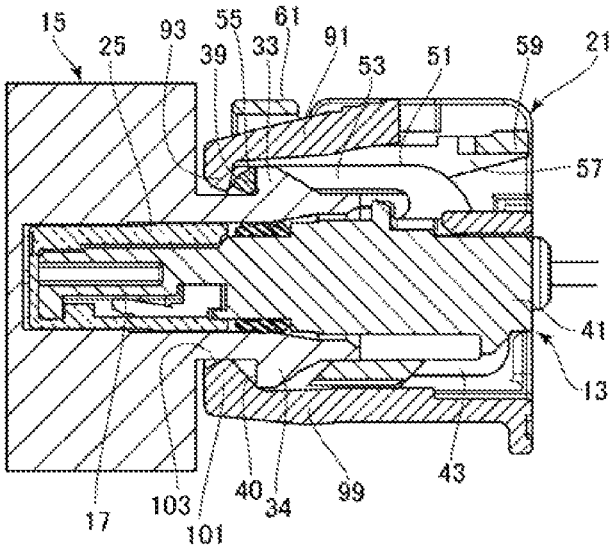
FIG. 8 is a longitudinal section view in a CPA final locking state.

Subsequently, the upper locking nail 93 passes the upper flat surface 37. After the upper locking nail 93 climbs over the locking piece 55 locked to the upper locking projection 33, the upper locking nail 93 is restored and displaced as shown in FIG. 8, and is locked to the upper locking surface 39 with the locking piece 55 being placed therebetween (CPA final locking). In this way, in the state in which the CPA upper arm 91 is locked to the upper locking projection 33 (the CAP 21 is set to the CPA final locking position), both the housings 13 and 15 are always locked, and thus fitting of both the housings 13 and 15 is assured by fitting of the CPA upper arm 91 (CPA final locking). Since the locking piece 55 is sandwiched between the upper locking projection 33 and the upper locking nail 93, the female housing 13 is prevented from being released. After the lower locking nail 101 passes the lower flat surface 38, the lower locking nail 101 is restored and displaced, and is locked to the lower locking projection 34 at the same time as the upper locking nail 93 is locked.

In the exemplary embodiment described above, the arm inclined portion 153 of the repulsion arm 65 is disposed to allow the leading end portion 133 of the arm contact portion 131 of the male housing 15 to start sliding on the inner inclined surface 157 of the arm inclined portion 153 before the female housing and the male housing are fitted to each other, and to allow the leading end portion 133 of the arm contact portion 131 to be positioned on the inner inclined surface 157 until the female housing 13 and the male housing 15 are fitted to each other. The leading end portion 133 of the arm contact portion 131 on the inner inclined surface 157 receives a reaction force from the inner inclined surface 157, and a component force of the corresponding reaction force is applied to the female housing 13 as a repulsive force related to the connector fitting. Accordingly, the repulsive force generated by the repulsion arm 65 can be applied until the fitting is completed, and half-fitting can be prevented.

In the connector fitted state, since the repulsion arm 65 of the female housing 13 is maintained in a state when the repulsion arm 65 is sandwiched between the arm contact portion 131 of the male housing 15 and the arm displacement regulation portion 135 of the CPA 21, and is elastically deformed, a rattle of the female housing 13 with respect to the male housing 15 and the CPA 21 can be prevented by an elastic force (restoring force) of the repulsion arm 65.

Since a portion of the outer housing 43 functions as the repulsion arm 65, enlargement of the entire connector 11 attributable to installation of the repulsion arm 65 can be avoided.

Since the repulsion arm 65 is sandwiched between the arm contact portion 131 and the arm displacement regulation portion 135 and is elastically deformed, and is stretched in the straight line in the longitudinal direction in the connector fitted state, degradation of rigidity of the outer housing 43 caused by using a portion of the outer housing 43 as the repulsion arm 65 can be prevented.

Although embodiments have been described with reference to the drawings, the embodiments are merely examples of the present invention, and a change or modification would be made within the scope of the invention.

For example, in the above-described exemplary embodiment, the upper locking nail 93 of the CPA upper arm 91 is locked to the upper locking projection 33 via the locking piece 55 of the housing arm 51. However, this should not be considered as limiting, and for example, the locking piece 55 and the upper locking nail 93 may be configured to be locked to different locking surfaces.

In accordance with embodiments, a connector 11 includes a connector housing 13 and a fitting assurance member 21. The connector housing 13 is to be fitted to a mating connector housing 15 by moving in a fitting direction with respect to the mating connector housing 15. The fitting assurance member 21 is slidably attached on an outside of the connector housing 13, and configured to be locked to the mating connector housing 15 by relatively sliding toward the mating connector housing 15 in a connector fitted state in which the connector housing 13 is fitted to the mating connector housing 15.

The connector housing includes a repulsion arm 65. An arm base end portion 151 and an arm inclined portion 153 are integrally formed in the repulsion arm 65. The arm base end portion 151 is supported on the connector housing 13 and includes a cantilever structure having a fixing end on a fitting side with the mating connector housing (15) and extending toward an opposite fitting side along the fitting direction. The arm inclined portion 153 extends from a leading end of the arm base end portion 151 to an arm leading end on the opposite fitting side, and the arm inclined portion 153 is inclined inward the connector housing 13 with respect to the arm base end portion 151. The fitting assurance member 21 includes an arm displacement regulation portion 135 facing an outside of the repulsion arm 65 to regulate a displacement of the repulsion arm 65 toward an outside. The arm inclined portion 153 is arranged so that a leading end portion 133 of an arm contact portion 131 of the mating connector housing 15 comes into contact with an inside of an inner inclined surface 157 of the arm inclined portion 153 and the leading end portion 133 of the arm contact portion 131 of the mating connector housing 15 slides on the inside of the inner inclined surface 157 of the arm inclined portion 153 by a movement of the connector housing 13 in the fitting direction. The repulsion arm 65 is configured, so that the repulsion arm 65 is sandwiched between the arm contact portion 131 and the arm displacement regulation portion 135 and the repulsion arm 65 is elastically deformed to be pressed to an outside by the leading end portion 133 of the arm contact portion 131 to be stretched in a straight line, when the leading end portion 133 of the arm contact portion 131 slides on the inner inclined surface 157 toward an arm leading end 155 of the repulsion arm 65. The arm inclined portion 153 is arranged so that the leading end portion 133 of the arm contact portion 131 starts sliding on the inner inclined surface 137 of the arm inclined portion 153 before the connector housing 13 and the mating connector housing 15 are fitted to each other, and the leading end portion 133 of the arm contact portion 131 is positioned on the inner inclined surface 137 of the arm inclined portion 153 until the connector housing 13 and the mating connector housing 15 are fitted to each other.

In the above-described structure, the leading end portion of the arm contact portion of the mating connector housing starts sliding on the inner inclined surface of the repulsion arm before the connector housing and the mating connector housing are fitted to each other, and is positioned on the inner inclined surface until the connector housing and the mating connector housing are fitted to each other. The leading end portion of the arm contact portion on the inner inclined surface receives a reaction force from the inner inclined surface, and a component force of the corresponding reaction force is applied to the connector housing as a repulsive force related to the connector fitting. Accordingly, the repulsive force generated by the repulsion arm can be applied until the fitting is completed, and half-fitting can be prevented.

In the connector fitted state, since the repulsion arm of the connector housing is maintained in a state when the repulsion arm is sandwiched between the arm contact portion of the mating connector housing and the arm displacement regulation portion of the fitting assurance member, and is elastically deformed, a rattle of the connector housing with respect to the mating connector housing and the fitting assurance member can be prevented by an elastic force (restoring force) of the repulsion arm.

The connector housing 13 includes an outer housing 43 to be disposed on an outside of the mating connector housing 15. The repulsion arm 65 has a plate shape that is partitioned and defined on a portion of the outer housing 43 by a slit.

In the above-described structure, since a portion of the outer housing functions as the repulsion arm, enlargement of the entire connector attributable to installation of the repulsion arm can be avoided.

Since the repulsion arm is sandwiched between the arm contact portion and the arm displacement regulation portion and is elastically deformed, and is stretched in the straight line in the fitting direction in the connector fitted state, degradation of rigidity of the outer housing caused by using a portion of the outer housing as the repulsion arm can be prevented.

According to the structure of the embodiments, a repulsive force can be exactly applied until the fitting is completed.

What is claimed is:

1. A connector comprising:

a connector housing to be fitted to a mating connector housing by moving in a fitting direction with respect to the mating connector housing; and a fitting assurance member slidably attached on an outside of the connector housing, and configured to be locked to the mating connector housing by relatively sliding toward the mating connector housing in a connector fitted state in which the connector housing is fitted to the mating connector housing, wherein the connector housing includes a repulsion arm, wherein an arm base end portion and an arm inclined portion are integrally formed in the repulsion arm, wherein the arm base end portion is supported on the connector housing and includes a cantilever structure having a fixing end on a fitting side with the mating connector housing and extending toward an opposite fitting side along the fitting direction, wherein the arm inclined portion extends from a leading end of the arm base end portion to an arm leading end on the opposite fitting side, and the arm inclined portion is inclined inward the connector housing with respect to the arm base end portion, wherein the fitting assurance member includes an arm displacement regulation portion facing an outside of the repulsion arm to regulate a displacement of the repulsion arm toward an outside, wherein the arm inclined portion is arranged so that a leading end portion of an arm contact portion of the mating connector housing comes into contact with an inside of an inner inclined surface of the arm inclined portion and the leading end portion of the arm contact portion of the mating connector housing slides on the inside of the inner inclined surface of the arm inclined portion by a movement of the connector housing in the fitting direction, wherein the repulsion arm is configured, so that the repulsion arm is sandwiched between the arm contact portion and the arm displacement regulation portion and the repulsion arm is elastically deformed to be pressed to an outside by the leading end portion of the arm contact portion to be stretched in a straight line, when the leading end portion of the arm contact portion slides on the inner inclined surface toward an arm leading end of the repulsion arm, and wherein the arm inclined portion is arranged so that the leading end portion of the arm contact portion starts sliding on the inner inclined surface of the arm inclined portion before the connector housing and the mating connector housing are fitted to each other, and the leading end portion of the arm contact portion is positioned on the inner inclined surface of the arm inclined portion until the connector housing and the mating connector housing are fitted to each other.

2. The connector according to claim 1, wherein the connector housing includes an outer housing to be disposed on an outside of the mating connector housing, and wherein the repulsion arm has a plate shape that is partitioned and defined on a portion of the outer housing by a slit.

* * * * *